United States Patent [19]

Schmitt et al.

[11] 4,417,222

[45] Nov. 22, 1983

[54] CIRCUIT BREAKER

[75] Inventors: Herrmann Schmitt, Edingen-Neckarhausen; Rudolf Sellner, Eppelheim; Klaus Greefe, Wilhelmsfeld, all of Fed. Rep. of Germany

[73] Assignee: Brown, Boveri & Co. Aktiengesellschaft, Mannheim, Fed. Rep. of Germany

[21] Appl. No.: 272,202

[22] Filed: Jun. 10, 1981

[30] Foreign Application Priority Data

Jun. 11, 1980 [DE] Fed. Rep. of Germany ..... 3021867

[51] Int. Cl.[3] ..... H01H 75/00; H01H 77/00; H01H 73/48

[52] U.S. Cl. ..... 335/6; 335/23; 335/35

[58] Field of Search ..... 335/6, 11, 13, 23, 35, 335/39, 40; 361/115

[56] References Cited

U.S. PATENT DOCUMENTS

| | | | |
|---|---|---|---|
| 3,467,920 | 9/1969 | Hall et al. | 335/23 |
| 4,090,156 | 5/1978 | Gryctko | 335/6 |
| 4,178,572 | 12/1979 | Gaskill et al. | 335/6 X |
| 4,215,328 | 7/1980 | Chabot et al. | 335/6 |

FOREIGN PATENT DOCUMENTS

| | | | |
|---|---|---|---|
| 2945683 | 5/1981 | Fed. Rep. of Germany | 335/23 |

*Primary Examiner*—William M. Shoop

*Attorney, Agent, or Firm*—Herbert L. Lerner; Laurence A. Greenberg

[57] ABSTRACT

An automatic switch of this type includes a switch latch for interrupting current, an overload tripping device and a short-circuit current tripping device for acting on the switch latch to trigger a current interruption. Generally there is also included at least one main contact device having at least one stationary contact and at least one movable contact, a movably supported contact lever attached to the at least one movable contact, and at least one arc quenching device associated with each main contact device. The improvement according to the invention includes a combination of an additional armature system having a magnet coil, a magnet core, a magnet armature and a striker pin. The striker pin is operable for directly striking the at least one movable contact lever and for lifting the at least one movable contact from the at least one stationary contact for a given limited time in the event of short-circuit currents, and the short-circuit current tripping device is in the form of a selective protection tripping device.

33 Claims, 10 Drawing Figures

10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
91
92
93
94

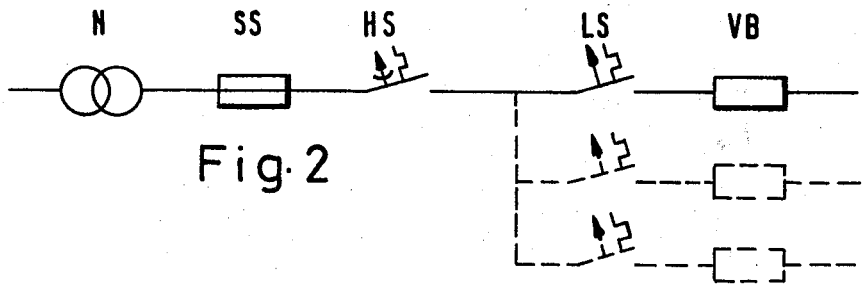
Fig. 2
Fig. 3
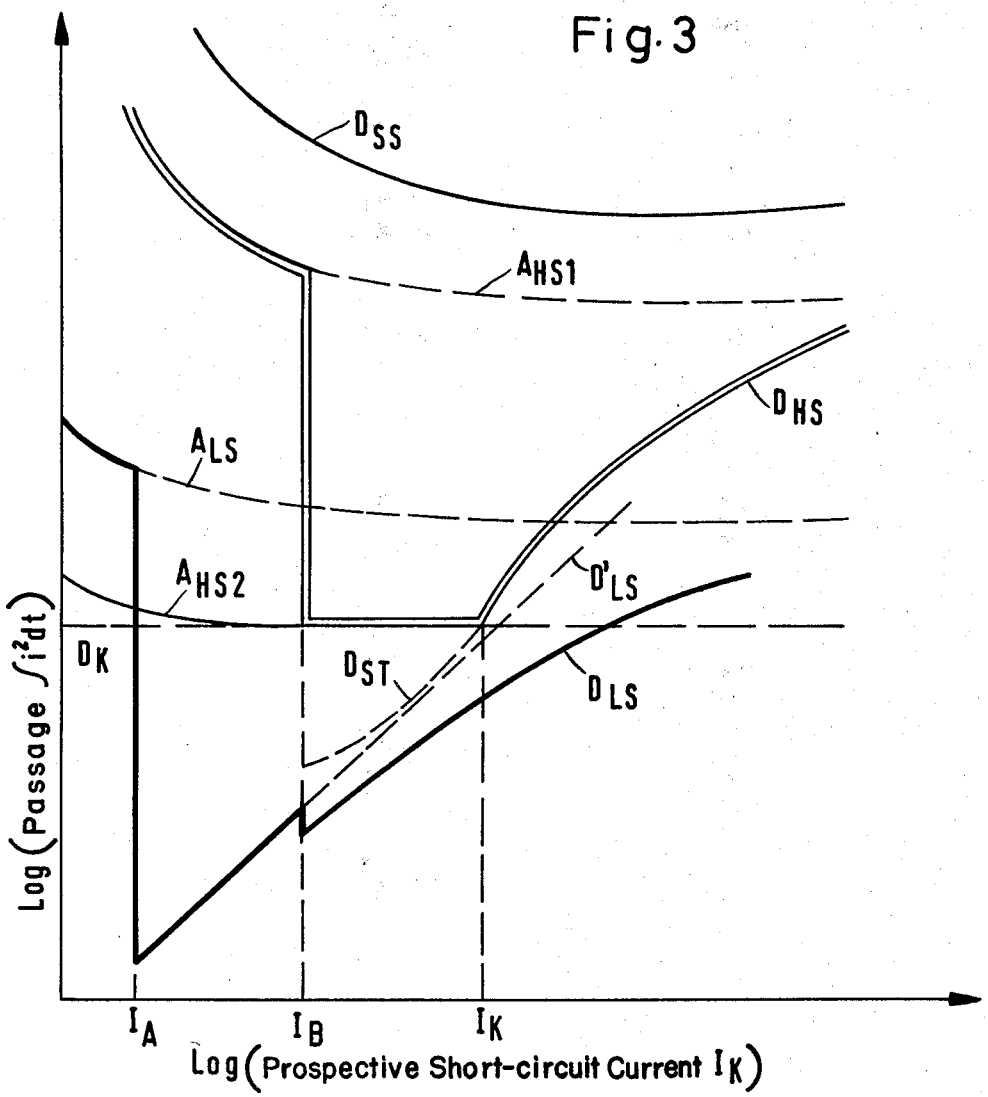

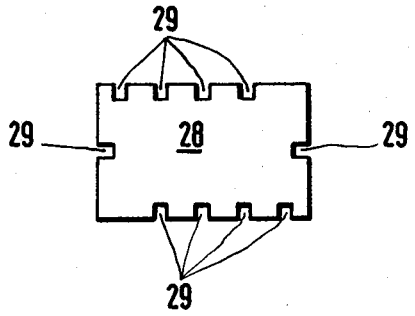
Fig.9
Fig.10
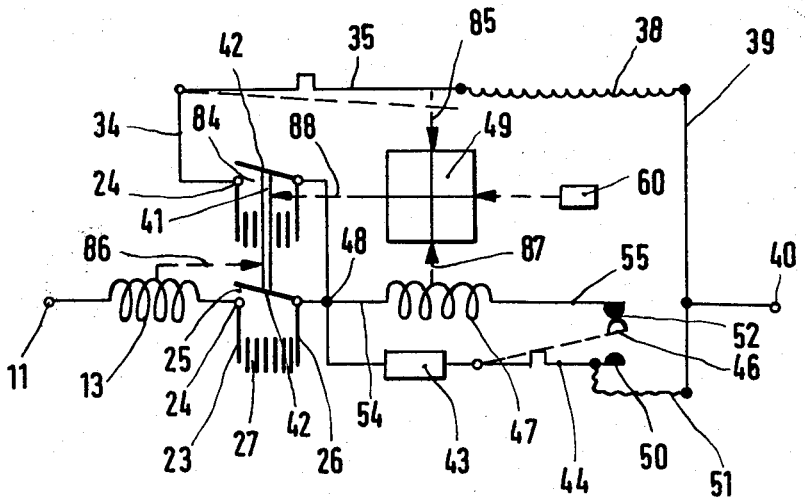

CIRCUIT BREAKER

The invention relates to an automatic switch with an overload and a short-circuit current tripping device which act on a switch latch for the purpose of triggering a current interruption, at least one contact location which is formed by at least one stationary contact and at least one movable contact that is fastened on a movably supported contact lever, and at least one arc quenching device associated with each of the contact locations.

For overload, and short-circuit current protection, line protection breakers have been used more and more frequently in recent times, besides fuses. The breakers have a thermal time-delayed tripping device for triggering a magnetic undelayed tripping device in the event of an overload current, and for triggering in the event of a short-circuit current. The thermal tripping device is usually provided in the form of a thermo-bimetal which is bent if an overload current occurs, and thereby releases the switching mechanism of a switch latch and separates the contact lever or the movable contact from the stationary contact. This thermal tripping device is a so-called delayed tripping device since it responds to an overload current only after a certain amount of time due to heating. As is well known, a magnet armature system is provided as the magnetic tripping device, which responds practically without delay and opens the contact immediately or releases the switch latch.

There are generally several deployment possibilities for an automatic switch of this type.

In a first application, the line protection breaker can follow upon a series fuse, where it must be triggered in the event of a short circuit ahead of the consumer in such a way that the series fuse neither blows in the overload current range nor in the short-circuit current range.

It is also possible to use the line protection switch as the main line protection breaker between the series fuse and a group protection, automatic watt-hour meter protection or the like. With such a use basic difficulties arise for this breaker if selective triggering is desired. This is because it must trigger in the event of overload currents in order to protect the following line section in the overcurrent range. However, it must not trigger in the event of short circuits in the vicinity of the consumers, if the switching capacity of the automatic switch associated with the load is not exceeded. Only then is the selectively of the breakers preceding the loads preserved, relative to the main line protection breaker following the series fuse.

In order to achieve this, it has become known through German Published Non-Prosecuted Application DE-OS 25 25 192 to assign a tripping device control and a fast-opening device for the contact to each breaker arranged serially in a power circuit. The opening device is of such a construction that it quickly opens the switch contacts through which the overcurrent flows at the different stages. It is furthermore constructed in such a way that it makes it possible to reclose the contacts quickly if the value of the current drops below a predetermined value. For the purpose of selectivity, the tripping control includes a counter which counts the successive opening and closing sequences of the contacts and which can cause the tripping after a predetermined number of sequences so as to keep the contacts of the corresponding breaker open after a predetermined number of sequences. This means that the breaker which is assigned directly to the consumer, opens after one opening. The superimposed breaker remains open after two openings, and the breaker superimposed on that after three openings, etc. The problem arises in this context that for constructing the device, a resettable counting device is required, which menas that a mechanical or complicated electronic counting device with a mechanical or electronic power storage device, which is independent of the network, must be developed and provided.

This complication becomes a problem particularly if the breakers are to be very inexpensive and used in large quantities. In addition, the device described in German Published Non-Prosecuted Application DE-OS 25 25 192 is immediately intended only for installations without fuses.

In the event of particularly large short-circuit currents, it would be highly desirable if the breaker, which is connected directly in series with the disturbed point, trips immediately and finally. This requirement, however, is met by the selective protection device described herein only in the case of a disturbance, which is in the vicinity of one of the consumers, but not in the event of disturbances which occur between two succeeding breakers, because a final tripping takes place there only after the provided counting sequence has been traversed.

It is accordingly an object of the invention to provide an automatic switch, particularly for a selective protection device, which overcomes the hereinafore-mentioned disadvantages of the heretofore-known devices of this general type, dispensing with a resettable counting device, and to describe a simple and advantageous construction. It is a further object of the invention to construct the automatic switch so that, from a given magnitude of the short-circuit current being on, at least one switch contact of the automatic switch opens immediately and for a short time for the purpose of interrupting the current, but closes again after the current is interrupted or has decayed to a small value; that the switch latch is released in the event of a loner-lasting overload or short-circuit current; that the at least one switch contact opens finally, and that the at least one contact opens immediately and finally if a given increased short-circuit current value is exceeded.

With the foregoing and other objects in view there is provided, in accordance with the invention, an automatic switch, comprising a switch latch for interrupting current, an overload tripping device and a short-circuit current tripping device for acting on the switch latch to trigger a current interruption, at least one main contact device having at least one stationary contact and at least one movable contact, a movably supported contact lever attached to the at least one movable contact, at least one arc quenching device associated with each main contact device, and an additional armature system having a magnet coil, a magnet core, a magnet armature and a striker pin, the striker pin being operable for directly striking the at least one movable contact lever without delay and for quickly lifting the at least one movable contact from the at least one stationary contact for a given limited time in the event of short-circuit currents, the short-circuit current tripping device being in the form of a selective protection tripping device.

The term "selective protection tripping device" designates herein a tripping control which has a double-throw switching device in the current path of the automatic switch, that switches the current at least in part to a parallel branch provided with a magnetic tripping device if a short-circuit current occurs, the parallel branch containing a device which, after a predetermined passing value $\int i^2dt$ has passed, increases the current through the coil of the magnet tripping device to such an extent that the magnet tripping device trips a switch latch which finally opens the at least one main contact.

In the event of short-circuit currents, the contact system of the automatic switch according to the invention can be opened without delay, for a short time, and without influencing the switch latch and tripping control, where the switch latch in the cocked condition permits opening and closing of the contacts in an unimpeded manner. Short-circuit current tripping takes place only through the selective protection tripping device.

The special advantage of the solution according to the invention manifests itself particularly well if the automatic switch is used as the main line protection switch of a selective protection arrangement, in which, between the network and at least one consumer, a fuse, a main line protection switch and a circuit breaker assigned to each consumer are arranged. In this arrangement, if a short-circuit current occurs in the vicinity of the consumers, the contact system of the main line protection switch is opened in addition to the contact of the line protection switch. Thus, several arcs occur in series, which limits the short-circuit current in a decisive way. If the short-circuit current does not exceed the switching capacity of the line protection breaker assigned to the consumer, the contact system of the main line breaker according to the invention is reclosed immediately, so that parallel-connected consumers are not separated from the network. In the case of larger short circuit currents, the main line protection switch trips by means of its selective protection tripping device and disconnects all parallel-connected consumers.

In accordance with another feature of the invention, there is provided a narrow dish-shaped two-part housing for the automatic switch.

In accordance with a further feature of the invention, there is provided a first terminal, the additional armature system being disposed in the immediate vicinity of the at least one arc quenching device and in the vicinity of the first terminal.

In accordance with an additional feature of the invention, there are provided plates covering the switch latch, the movable contact lever being rotatably supported by the plates.

In accordance with an added feature of the invention, the switch latch includes a member protruding from substantially the middle of the front of the housing for manually actuating the switch latch, a lever for tripping the switch latch, and a lever for opening the contacts, the additional armature system having an exit opening for the striker pin formed therein, and the movable contact lever being disposed in front of the exit opening.

In accordance with yet another feature of the invention, the tripping lever of the switch latch and the movable contact lever are disposed on two diametrically opposite sides of the switch latch, and the overload tripping device and the short-circuit tripping device are disposed in the immediate vicinity of the tripping lever for directly acting thereon.

In accordance with yet a further feature of the invention, there is provided a second terminal, the overload and short-circuit current tripping devices being disposed in the vicinity of the second terminal.

In accordance with yet an additional feature of the invention, the at least one main contact device is in the form of two main contacts each having an arc quenching device, and the arc quenching devices include a partition of insulating material having two sides and quenching chambers on both sides of the partition.

The relationship of the parts is in line with their function, the current-carrying lines are short, the utilization of the space in the breaker housing is optimum, the assembly of the parts poses no problem, and perfect accessibility of the terminals, setting and operating organs of the automatic switch which must be operated from the outside is assured.

In accordance with yet an added feature of the invention, there is provided a permanent magnet holding the magnet armature of the additional armature system in a starting position, the permanent magnet being torn away from the magnet armature for driving the striker pin only after a predetermined short-circuit current value is exceeded. This construction has the advantage over the heretofore customary use of a restoring coil spring, that the retaining force in the rest position of the magnet armature is large, but after the magnet armature is torn away due to a short-circuit current, it goes fast toward zero. This reduces the contact opening time.

In accordance with still another feature of the invention, the contact opening lever of the switch latch acts on the movable contact lever exclusively when the switch is tripped and lifts the at least one movable contact from the at least one stationary contact.

In accordance with still a further feature of the invention, the at least one main contact device is in the form of two electrically series-connected main contacts each having an associated arc quenching device.

In accordance with still an additional feature of the invention, the movable contact lever is in the shape of a fork having fork ends, and one of two movable contact of the two main contacts is disposed on each fork end.

In accordance with still an added feature of the invention, the movable contact lever is of symmetrical construction, having a plane of symmetry disposed between the two movable contacts.

In accordance with another feature of the invention, the switch latch includes side plates, and the movable contact has first and second opposite sides and includes a stationary shaft fastened to the side plates on which the movable contact lever is rotatably supported at a support point in the plane of symmetry at the first opposite side, and the movable contacts are disposed at the second opposite side and are swingable in a pendulum motion.

In accordance with a further feature of the invention, there is provided a pendulum shaft having ends and being centrally engaged in the movable contact lever between the movable contacts and the support point, and two contact pressure tension springs each having two opposite ends, one of the springs being hung at one end thereof from each end of the pendulum shaft.

In accordance with an additional feature of the invention, the side plates have stationary abutments formed thereon, and the other end of each of the springs opposite the one end hung on the pendulum shaft, being hung on one of the abutments.

In accordance with an added feature of the invention, the pendulum shaft engages the movable contact lever at a given engagement point, and an imaginary line drawn between the engagement point and the support point forms an acute angle with an imaginary line drawn between the engagement point and one of the stationary abutments.

In accordance with an alternate feature of the invention, the fork-shaped movable contact lever includes a U-shaped contact part having two legs carrying the movable contacts, a first angle piece and two second angle pieces fastened to the legs, the first angle piece being disposed flat on the U-shaped contact part and the second angle piece being disposed perpendicularly t the first piece in the plane of symmetry, the second angle pieces being connected to each other and having holes formed therein for receiving the pendulum shaft and for forming the support point.

Due to the described embodiments and suspension features of the contact lever, the lever can execute pendulum movement which ensures the same contact pressure at both main contacts even for different contact burn-offs. The pendulum movement is aided by the provision of a narrow support of the contact lever. Through the proposed arrangement of the contact pressure tension spring, the contact pressure increases only inappreciably during an excursion of the contact lever (opening of the contacts). This allows short contact opening times, particularly if the contacts are opened by the additional armature system.

In accordance with a still further feature of the invention, the movable contact lever has at least one leg, and the switch latch includes a double-armed contact opening lever having two free ends, and projections disposed on the free ends engaging behind the at least one leg of the movable contact lever for deflecting the movable contact lever from a closed position and opening the at least one main contact device when the switch latch is tripped.

Through this embodiment, the contact bridge can be moved out of its rest position (opening the contact), in that either the striker pin of the additional armature system strikes the contact bridge independently of the switch latch and deflects the contact bridge or, in that the contact opening lever of the switch latch pulls up the contact lever by means of its two projections.

In accordance with yet another feature of the invention, the switch latch opens the contact a given distance when it is tripped, and the movable contact lever is movable through a distance between the movable and stationary contacts which is greater than the given distance.

This occurs if the contacts are opened by means of the armature system and is advantageous because the current limiting can be improved by a long instantaneous contact path.

In order to ensure that the arcs in the quenching chambers enter and are quenched in a controlled manner, which is important for the operation of the selective protection tripping device, it is proposed, in accordance with a yet a further feature of the invention, that each arc quenching device includes two arc guiding bars having ends, and a stack of deion laminations being disposed between the bars and having ends protruding beyond the bar ends, so that the partial arcs burning between the deion laminations cannot combine behind the respective stack of quenching laminations to form one arc. On the other hand, in accordance with yet an additional feature of the invention, the arc quenching device has an entrance side for an arc and an opposite side, and an insulating plate covering the opposite side.

In accordance with an added feature of the invention, the insulating plate is formed of a material which gives off gases upon being heated.

In accordance with still another feature of the invention, the insulating plate is formed of plexiglass.

Due to the gas liberation, a pressure build-up occurs because of which the arc is urged back, so that its unintended issue from the stack of quenching laminations is made more difficult. The arc is furthermore additionally cooled thereby.

In accordance with still a further feature of the invention, the insulating plate has break-throughs formed therein.

In accordance with still an additional feature of the invention, there is provided a switch housing having a side adjacent the at least one arc quenching device and having venting openings formed in the side in labyrinth fashion by offset webs for pressure equalization.

In accordance with still an added feature of the invention, the at least one main contact device is in the form of a first series-connected main contact and a second series-connected main contact being connected in series with the overload tripping device, and there are provided first and second terminals, and an arc guiding bar associated with the movable contact of the first main contact, the short-circuit current tripping device being electrically conductingly connected between the arc guiding bar and the second terminal and being shunted across the second main contact and the overload tripping device.

In accordance with yet another feature of the invention, the switch latch includes a tripping lever, and the short-circuit current tripping device includes a temperature-sensitive tripping device having a free end and a clamped end, an electric resistor having a free lead connected to the arc guiding bar and another lead connected in series with the clamped end of the temperature-sensitive tripping device, the free end of the temperature-sensitive tripping device being connected to the second terminal and there is provided a first contact of an auxiliary contact being open in a no-current condition of the switch, a second contact of the auxiliary contact being disposed opposite to the first contact thereof, and a magnetic tripping device being connected parallel to the resistor and temperature-sensitive tripping device between the arc guiding bar and the second contact of the auxiliary contact, the magnetic end tripping device having a coil and a striker pin for acting on the tripping lever of the switch latch.

In accordance with yet a further feature of the invention, the temperature-sensitive tripping device of the short-circuit current tripping device is formed of a thermo-bimetal material.

In accordance with yet an additional feature of the invention, the temperature-sensitive tripping device of the short-circuit current tripping device is more sensitive than the overload tripping device.

With the embodiments of the invention just described, an electric circuit arrangement of the elements of the automatic switch as well as a construction reference for the tripping elements of the short-circuit current tripping device and the overload current tripping device which may, in particular, be thermo-bimetals, are described.

In accordance with yet an added feature of the invention, the resistor is formed of a chromium-aluminum alloy, which has a negative temperature coefficient.

This protects the thermo-bimetal following the resistor against major overcurrents.

In accordance with another feature of the invention, the temperature-sensitive tripping device is deflectable in a given direction, and there is provided a connecting line section electrically inserted between the free end of the temperature-sensitive tripping device and the second terminal, the connecting line section being disposed parallel to and at a small distance from the temperature-sensitive tripping device toward the given direction. Because of the electro-dynamic forces of a short-circuit current, the thermo-bimetal is attracted by the connecting conductor section, whereby its deflection due to heating is aided.

In accordance with a further feature of the invention, the temperature-sensitive tripping device is formed at least in part of ferromagnetic material, therefore the electrodynamic attraction is amplified.

In accordance with an additional feature of the invention, there is provided an automatic switch, comprising a dish-shaped two-part narrow housing for holding the switch having a rectangular profile, a front and walls, first and second terminals, a partition formed of insulating material, two arcing chambers in the vicinity of the first terminal being disposed one behind the other widthwise in the housing on either side of the partition, an additional armature system being disposed in the vicinity of the first terminal and in the immediate vicinity of the arcing chambers, a bridge of insulating material separating the additional armature system from the arcing chambers, the additional armature system having an exit opening formed therein and having a striker pin movable through the exit opening, a switch latch being disposed in front of the exit opening and having a manual actuating member protruding substantially centrally from the front of the housing, a forked movable contact lever disposed directly adjacent to the additional armature system, the movable contact lever being rotatably supported at a support point by the switch latch, being actuatable by the striker pin, and having two movable contacts disposed thereon, a tripping lever being attached to and extended beyond the switch latch diametrically opposite to the support point, an overload tripping device being disposed in the vicinity of the second terminal and in the vicinity of and parallel to one of the housing walls, the overload tripping device having a free end for acting on the tripping lever and a clamped end, and a short-circuit current tripping device in the form of a selective protection tripping device having a magnetic end tripping device also acting directly on the tripping lever.

In accordance with a concomitant feature of the invention, the overload tripping device is a thermo-bimetal strip.

Other features which are considered as characteristic for the invention are set forth in the appended claims.

Although the invention is illustrated and described herein as embodied in an automatic switch, it is nevertheless not intended to be limited to the details shown, since various modifications and structural changes may be made therein without departing from the spirit of the invention and within the scope and range of equivalents of the claims.

The construction and method of operating of the invention, however, together with additional objects and advantages thereof will be best understood from the following description of specific embodiments when read in connection with the accompanying drawings, in which:

FIG. 2 is a schematic and diagrammatic view of an arrangement of an automatic switch cascade;

FIG. 3 is a passage diagram for an automatic switch according to the invention;

FIG. 9 is an elevational view of an insulating material plate of the arc quenching chamber; and FIG. 10 is a schematic circuit diagram and diagrammatic view of an automatic switch according to the invention.

Figure 1:
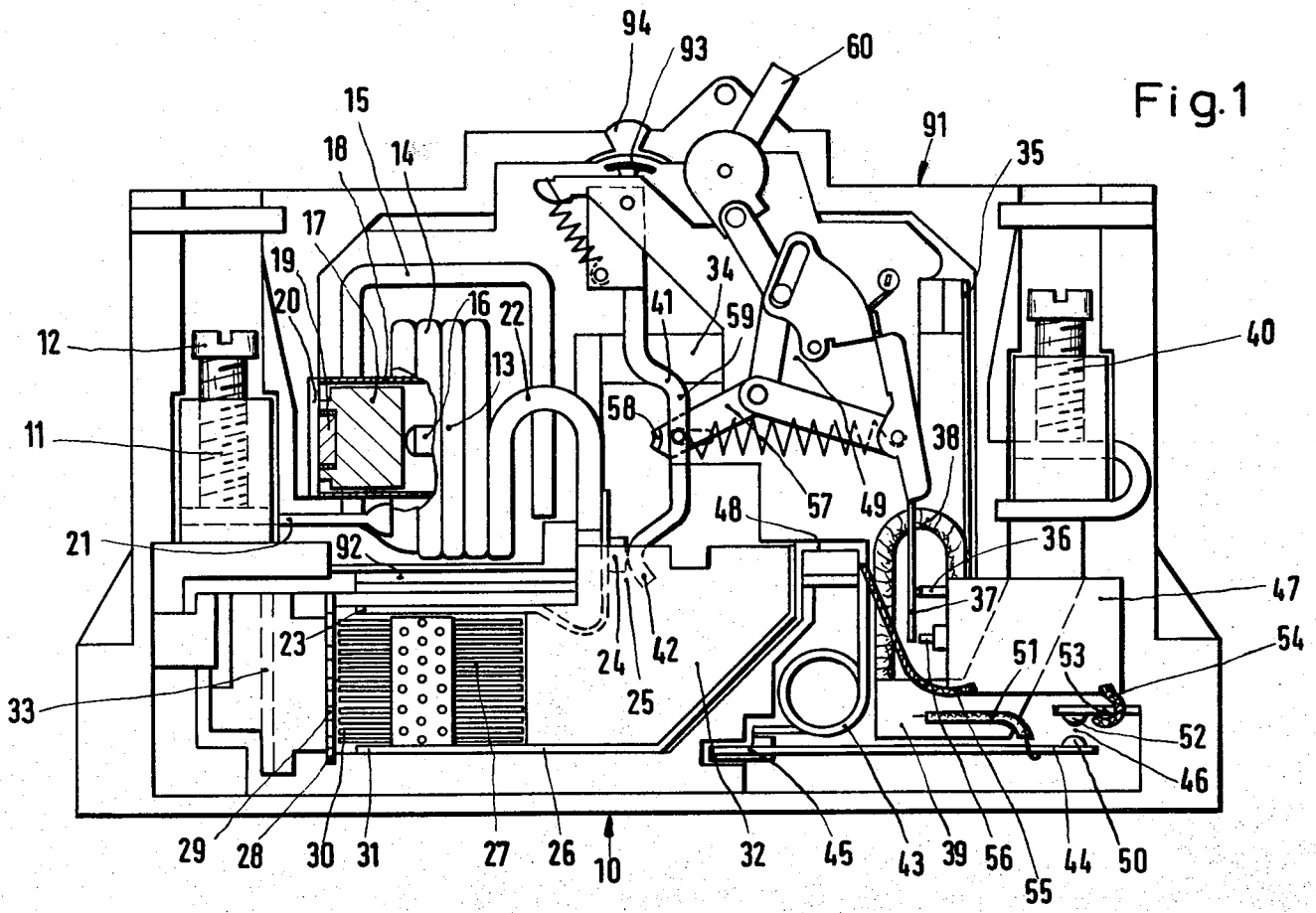
FIG. 1 is a diagrammatic elevational view of an automatic switch according to the invention in an opened housing.

Referring now to the figures of the drawing and first particularly to FIG. 1 thereof, there is seen the interior of an automatic switch according to the invention in an opened, dish-shaped two-part housing of narrow construction, which stands on its lower housing edge 10. An armature system 13 shown in cross section is located in the vicinity of a first terminal 11 having a screw 12. The armature system 13 includes a magnet coil 14 which is provided as a wire winding, an iron yoke 15, a striker pin 16, a non-illustrated magnet core, a magnet armature 17 and a metal sleeve 18 which is located between the magnet coil 14 on one hand, and the magnet armature 17, on the other hand, and in which the magnet armature 17 moves. The magnet armature 17 carries a permanent magnet shackle on one end thereof protruding from the magnet coil 14. The permanent magnet shackle which includes a permanent magnet 19 inserted into the magnet armature 17 and a ferromagnetic holding plate 20. One end 21 of the magnet-coil wire is connected to the first terminal 11. An arc guide bar 23 which carries a fixed contact 24 is fastened to the other end 22 of the magnet-coil wire.

Between the lower edge 10 of the housing and the armature system 13 an arc quenching device is disposed, separated by a web of insulating material 92. The arc quenching device includes two guide bars 23 and 26, a stack of quenching laminations 27 therebetween, and an insulating sheet 28 with break-throughs 29. The ends 30 of the deion laminations of the stack of quenching laminations 27 extend beyond the ends 31 of the guide bars 23 and 26. The arcing chamber is covered by two ceramic plates 32, only one of which is visible. In the side of the breaker housing, which the ends 30 of the deion laminations face, there is disposed a labyrinth-like system of venting opening 33 which is formed by offset webs and makes gas pressure equalization possible. Behind the arc quenching device shown, an identical arc quenching device is provided, but is covered up and therefore not shown. The arc quenching devices are separated from each other electrically by a partition of insulating material. However, their two lower guide bars 26 are electrically connected to each other. The upper guide bar of the non-illustrated rear arc quenching device which corresponds to the guide bar 23, likewise carries a stationary contact (corresponding to the contact 24). The contact is connected by an insulated rigid connecting line 34 to the clamped end of a thermo-bimetal strip 35 which serves as the overcurrent tripping device and is fastened in the vicinity of a second terminal 40, approximately parallel to the housing wall. The free end of the thermo-bimetal strip 35 has a tapped hole formed therein, into which an adjusting screw 36 is screwed and disposed so as to be accessible from the outside of the switch (through appropriate openings that are not shown). If heated-up by an overload current, the thermo-bimetal strip 35 is bent with its free end displaced in the direction toward the middle of the switch, so that the adjusting screw 36 pushes against a tripping lever 37 of the switch latch 49, which will be described hereinbelow, and trips the latch. A flexible connecting lead 38 is further fastened to the free end of the thermo-bimetal strip 35. The other end of the lead 38 is connected to a rigid connecting conductor section 39. The connecting conductor section 39 leads to the second terminal 40.

Figure 5:
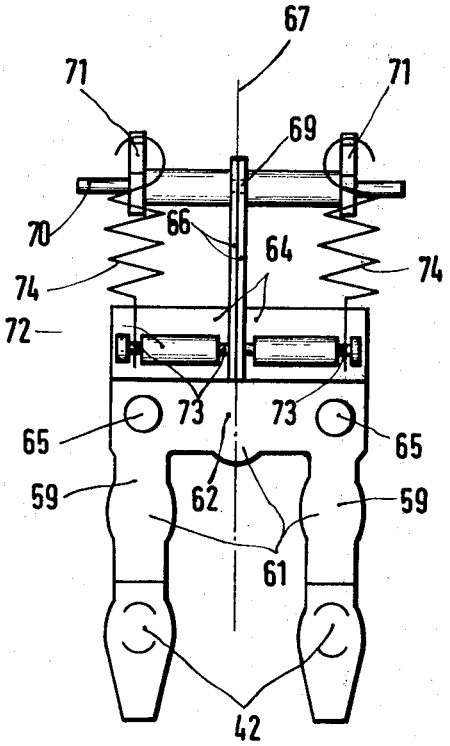
FIG. 5 is a top-plan view of a contact bridge according to FIG. 4.
Figure 6:
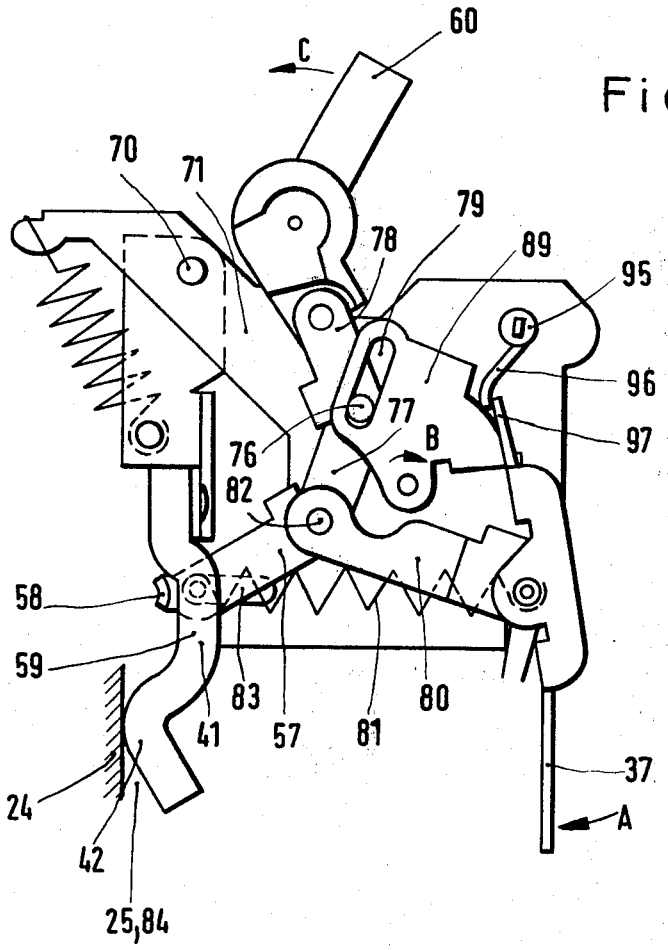
FIG. 6 is an elevational view of a switch latch in cocked condition.
Figure 7:
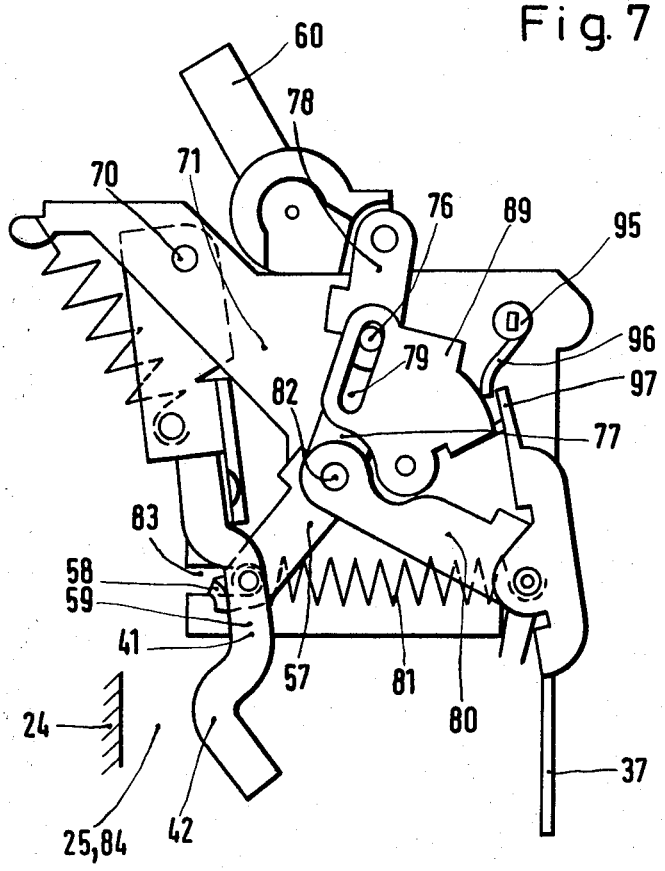
FIG. 7 is a view similar to FIG. 6 of a switch latch according to FIG. 6 in tripped condition.
Figure 8:
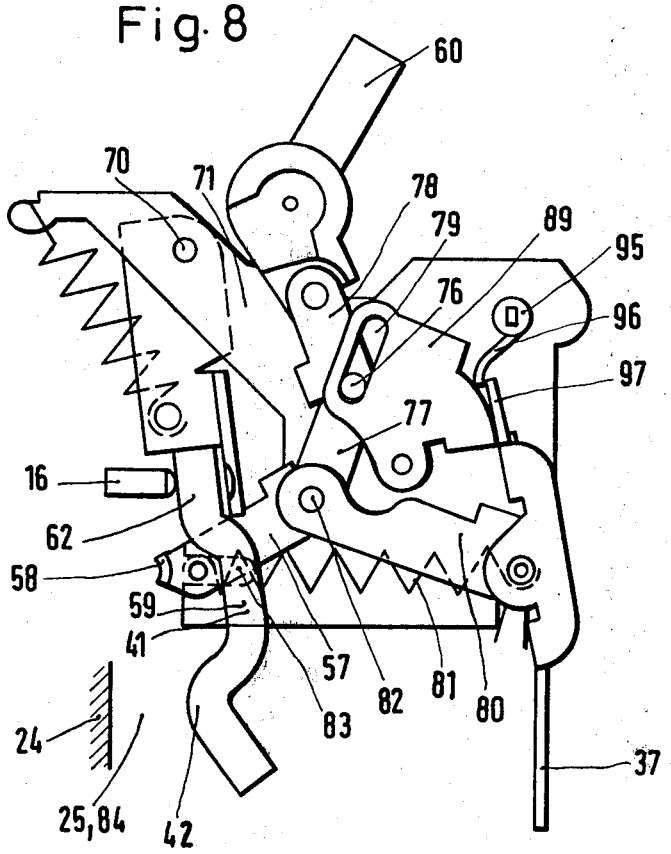
FIG. 8 is an elevational view of a switch latch according to FIG. 6 with a contact bridge which is deflected by a striker pin (in open position of the contact)

The switch latch 49 of the automatic breaker, which will be described in detail with reference to FIGS. 6 to 8, is located between the armature system 13 and the thermo-bimetal strip 35. The manual operating element 60 of the switch latch 49 protrudes upward approximately from the center of the front 91 of the breaker. A viewing glass 94 is inserted next to the manual operating member 60, in the front 91 of the switch. A switch position indicator 93, which is visible from the outside, is located under the glass 94. The switch position indicator 93 has a red and a green area that indicates the position of the movable contact 42 (main contact 25, 84 open or closed). To the left in the drawing, next to the switch latch 49 and fastened to the latter as well as supported rotatably, there is disposed a forked contact lever 41 with two arms 59, which will be described in detail with reference to FIGS. 4 and 5. The contact lever 41 has a movable contact 42 at each of its two legs 59. Together with the two stationary contact 24, these contacts from two main contacts 25, 84, only one of which, however, being visible.

Between the switch latch 49 and the thermo-bimetal strip 35, on one hand, and the lower edge of the housing 10, on the other hand, the short circuit current tripping device is disposed in the vicinity of the second terminal 40; it is constructed as a so-called selective protection tripping device. It includes a helically wound resistance wire 43, a thermo-bimetal element (tripping element) 44, one end 45 of which is fastened in the switch housing, an auxiliary contact 46 and a magnetic end tripping device 47 constructed as an armature system. Electrically, these elements are connected to each other as follows: one end of the resistance wire 43 is soldered to a lug 48 formed on the lower guide bar 26 as well as to the two housing plates 71 (shown in FIG. 5), between which the switch latch 49 is located. The other end of the resistance wire 43 is connected to the fixed, clamped end 45 of the thermo-bimetal element 44. The free end of the thermo-bimetal element 44 carries a first contact 50 of the auxiliary contact 46. In addition, the free end of the thermo-bimetal element 44 is connected to the connecting conductor section 39 by a flexible lead 5. Opposite the first contact 50 is a second contact 52 which is fastened to a copper angle bracket 53 that is firmly clamped in the switch housing. One end 54 of the coil wire of the magnetic end tripping device 47 is furthermore fastened to the copper angle bracket 53. The other end 55 of the coil wire is connected to the lug 48 and to the lower guide bar 26. The striker pin 56 of the end tripping device 47 is set in a magnet yoke and is aligned so that it acts on the tripping lever 37 like the adjusting screw 36 of the thermo-bimetal strip 35, if the end tripping device 47 is tripped.

The arrangement of the components of the automatic switch shown in FIG. 1 represents a particularly advantageous solution to the problem which the invention seeks to solve. The relation of the components is in line with their function. The current-carrying electrical conductors are short. The actuation of the contact lever 41 by the striker pin 16 or the operation of the tripping lever 37 by the adjusting screw 36 of the thermo-bimetal strip 35 or the striker pin 56 takes place directly and without additional levers. The space utilization in the switch housing is optimum. The components can be assembled without problem. Perfect accessibility of the terminal, adjusting and operating organs, to be operated from the outside of the automatic switch, is ensured.

A description of the operating of the automatic switch shown in FIG. 1 follows. The automatic switch is shown in its on-position, in which the main contacts 25, 84 are closed. The current to be monitored takes the following course within the automatic switch: It enters the automatic switch through the first terminal 11. It then flows through the magnet coil 14 of the armature system 13 through the first main contact 25, then through the forked contact lever 41 to the second main contact 84, which is not shown in FIG. 1, then through the rigid connecting line 34 to the thermo-bimetal strip 35, through the latter by way of the flexible connecting lead 38 to the connecting line section 39, and finally to the second terminal 40, from where the current leaves the automatic switch again. A partial current is branched off at the contact lever 41. The partial current flows through the housing plate 71 covering the switch latch, to the resistor 43, through the latter into the thermo-bimetal element 44, and is then conducted through the flexible lead 51 and the connecting conductor section 39 likewise to the second terminal 40.

In the event of an overload current, the thermo-bimetal strip 35 is deflected, whereby the adjusting screw 36 pushes against the tripping lever 37 of the switch latch and deflects the tripping lever 37. This trips the latch release of the switch latch 49. A double-armed contact opening lever 57 of the switch latch 49 is accelerated and pulls the contact lever 41 in the direction toward the switch latch 49 by means of its two projections 58 which engage behind a leg 59 of each arm of the two-armed contact lever 41, and thereby opens the main contact 25, 84. Through the opening of the two main contact 25, 84 there develops in each of the two quenching chambers an arc which jumps from the movable contact 42 to the lower guide bar 26, then burns between the upper guide bar 23 and the lower guide bar 26 and is driven into the respective stack 27 of quenching laminations. In the stack 27 the arcs are quenched, so that the current flow through the automatic switch is interrupted. Due to the series arrangement of two arc chambers, the entire arc voltage is clearly above the nominal voltage, so that the quenching of the arcs takes place quickly.

In the event of a short-circuit current, there are two possibilities for opening the contacts, namely a short-time operation which is caused by the armature system 13, and a lasting operation which is also initially started by the armature system 13 and is triggered by the short-circuit current tripping device through the tripping lever 37 of the switch latch 49.

If a short-circuit current should occur, the magnet armature 17 is torn loose from the permanent magnet shackel, (which only permits tearing loose because a given, constant amount of short-circuit is on), drives the striker pin 16 which strikes the contact lever 41 directly and without delay, and lifts the two movable contacts 42 from the stationary contacts 24. The switch latch 49 is not triggered by these events. The contact opening lever 57 remains in its position. As described above, two arcs develop which enter the stack 27 of quenching laminations. When the two main contact 25, 84 are opened, the voltage drop across the main contacts 25, 84 increases considerably (arc voltage). This results in an increased voltage drop across the short-circuit current tripping device, which is connected in parallel with the main contact 84 that is in series with the thermo-bimetal strip 35. This causes a larger current to flow through the short-circuit current tripping device, which causes the thermo-bimetal element 44 to heat up.

The thermo-bimetal element 44 is laid out in such a way that its deflection due to temperature does not lead to a closing of the auxiliary contact 46 for small short circuit currents. This happens only if either the short-circuit current exceeds a predetermined value or if it is present over a longer period of time, i.e. if a given passage value integral $\int i^2dt$ is exceeded.

If the passage value is not sufficient to close the auxiliary contact 46, the short-circuit tripping device does not release the switch latch 49. After the arcs are extinguished or after the switch current has dropped to a smaller value, the armature system 13 drops off and the contact lever 41 again closes the main contacts 25, 84.

If, however, the transmission value exceeds a predetermined value, the auxiliary contact 46 is closed. The magnetic and tripping device 47 therefore is connected in shunt to the main contact 84 which is in series with the thermo-bimetal element 44, and likewise at the arc voltage of the covered-up, non-visible arcing chamber. The arc voltage draws a current through the magnetic and tripping device 47 and thereby drives the striker pin 56, which acts on the tripping lever 37 of the switch latch 49 and releases the switch latch 49. The two-armed contact opening 57 is pulled into the switch latch housing and prevents the main contacts 25, 84 from closing by means of its projections 59 which hold back the double-arm contact lever 41. The current flow through the automatic switch is thereby permanently interrupted. The main contacts 25, 84 can be closed again only by actuating the manual operating member 60.

In order to ensure reliable tripping of the short-circuit current device for a predetermined passage value integral $\int i^2dt$, care must be taken that the voltage drop across the short-circuit current tripping device always assumes the same values again, under the same conditions. For this purpose, it is advantageous, as described above, to take off the voltage at a potential which is between two series-connected arc chambers. Furthermore, the arc must be prevented from leaving the stack 27 after entering the stack 27 of quenching laminations. This is achieved on one hand, by the provision that the stack 27 of quenching laminations is surrounded on all sides by insulating material plates 28, except for the entrance side of the arc. In addition, the deion laminations of the stack 27 of quenching laminations extend beyond the ends of the guide bars 23, 26, so that the arc is prevented from travelling beyond the ends of the deion laminations 30. Finally, such escaping of the arc is made more difficult by the provision that an insulating material plate is attached on the side of the stack 27 of quenching laminations facing away from the entrance side of the arc. The insulating material plate 28 is preferably formed of material which releases gases upon being heated, such as Plexiglass. This insulating material plate 28, which is shown in detail in FIG. 9, has breakthroughs 29 at its edge, for venting the arcing chamber. Pressure equalization with the exterior of the switch can take place through venting openings 33 which are made in the switch housing in labyrinth-fashion by offset webs. In order to ensure reliable tripping of the short-circuit current tripping device for a predetermined passage value, it is likewise important that the two main contacts 25, 84 open and close simultaneously, and in the closed position have equal contact pressure of the movable contacts 42. For this purpose, a special embodiment of the contact lever 41 as well as the suspension thereof is described and shown in FIGS. 4 and 5.

It will be seen from FIG. 1 that the thermo-bimetal element 44 of the short-circuit current tripping device is arranged in part parallel to the connecting conductor section 39. In particular, because the thermo-bimetal element 44 is ferro-magnetic, it is attracted by the magnetic field of the current-carrying connecting conductor section 39. In the case of large currents, this aids the thermal deflection of the thermo-bimetal element 44.

FIG. 3 shows a transmission diagram for an automatic switch according to the invention as described hereinafore. This diagram is based on a selective protection arrangement (shown in FIG. 2) in which a fuse SS, a main line-protection breaker HS and a line protection breaker LS are arranged between a network N and a consumer VB. In principle, further line protection breakers with consumers can be connected parallel to the line protection breaker LS. The curve $D_{SS}$ of FIG. 3 shows the melting characteristic of the fuse SS. The solid double-line curve $D_{HS}$ designates the transmission characteristic of a main line protection breaker HS according to the invention and is clearly below the melting characteristic $D_{SS}$ of the fuse SS in the entire range shown. The heavy solid-line curve $D_{LS}$ is the transmission characteristic of the line protection breaker LS; the curve $D_{LS}$ in turn, is clearly below the transmission characteristic $D_{HS}$ of the main line-protection breaker HS.

The characteristic $D_{HS}$ of the main line-protection switch HS is composed of three regions. In the region between $I=D$ and $I=I_B$, the tripping characteristic $A_{HS1}$ of the overload current tripping device, in this case the thermo-bimetal strip 35, governs exclusively.

In this region, the current flow is interrupted only if the corresponding pass value $\int i^2dt$ of the tripping characteristic $A_{HS1}$ is exceeded for an overload current. For overcurrents which are larger than $I_B$, the armature system 13 responds and leads to an opening of the main contacts 25, 84. In breakers according to the state of the art, the switch latch 49 is simultaneously released thereby, which leads to a permanent opening of the main contacts 25, 84. For these breakers, the characteristic $D_{ST}$ shown in dotted lines governs. In the automatic switch according to the invention, the armature system 13 likewise opens the main contacts 25, 84 if an overcurrent occurs which is larger than $I_B$. The armature system 13, however, does not release the switch latch 49, so that the main contacts 25 84 close again after the overcurrent had decayed. The switch latch 49 is tripped only if the thermo-bimetal element 44 of the short-circuit current tripping device closes the auxiliary contact 46 (for $I=I_K$). The tripping characteristic of this thermo-bimetal element 44 is shown in FIG. 3 with the curve $A_{HS2}$. It governs in the current region between $I_B$ and $I_K$ for the transmission of the automatic switch according to the invention.

It is only for short circuit currents which are larger than $I_K$, i.e. when the switch latch 49 is tripped, that part of the pass characteristic become effective which, according to the state of the art, depends substantially on the quenching properties of the arc quenching devices. The characterisic $D_{HS}$ of the automatic switch according to the invention, here the main line protection breaker HS, is slightly curved above the tripping current value $I_K$ and is rising.

The pass characteristics $D_{LS}$ and $D'_{LS}$ represent the current limiting properties of a line protection breaker. The characteristic $D'_{LS}$ characterizes the properties of a line protection breaker, having a current-limiting effect which is not aided by preceding line protection breakers, while the lower solid characteristic $D_{LS}$ relates to a line protection switch which is preceded by a main line protection breaker HS according to the invention. Below a current value $I_A$, the tripping characteristic $A_{LS}$ of the overload current tripping device of the line protection breaker LS governs for the pass characteristic, while for current values above $I_A$, the short-circuit current tripping device of the line protection breaker LS becomes effective. For short-circuit current values above $I_B$, the current-limiting action of the line protection breaker LS is aided by the arc voltage built-up in the main line protection breaker HS, so that the transmission characteristic $D_{LS}$ is below the transmission characteristic $D'_{LS}$ of a line protection switch LS considered by itself. Thus, the selectivity of the line protection breaker cascade is additionally improved.

Figure 4:
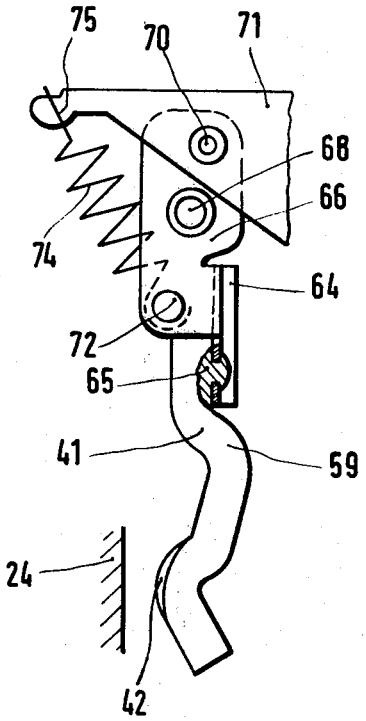
FIG. 4 is a side-elevational view of a contact bridge.

FIGS. 4 and 5 show a forked contact lever 41 of symmetrical construction. The lever 41 includes a U-shaped contact part 61, having two legs 59 which carry the movable contacts 42, and a connecting leg 62 on which two angular pieces are fastened. The first angular leg 64 rests flat on the U-shaped contact part 61, these parts being connected to each other by means of rivets 65. The second angular legs 66 is arranged perpendicularly thereto in the symmetry plane 67. The two second angular legs 66 which lie in the symmetry plane 67, are connected to each other by means of rivets 68.

The contact lever 41 is pivoted in its fulcrum 69 on a stationary shaft 70. The stationary shaft 70 is fastened to the two plates 71 which cover the switch latch 49. The contact lever 41 is engaged by a pendulum shaft 72, which has three grooves 73 formed therein. One end of a contact pressure tension spring 74 is hung into each of two pendulum shaft ends. The respective other ends of the contact pressure tension springs 74 are hung into respective stationary abutments 75 which are formed on the plate 71.

If the main contacts 25, 84 are closed, the contact pressure tension spring 74 pushes the contact lever 41 against the stationary contact 24. The contact pressure tension spring 74 is under a pretension. The connecting line between the support of the pendulum shaft 72 and the support 69 of the contact lever 41, and the connecting line between the support of the pendulum shaft 72 and the stationary abutment 75 enclose an acute angle. This arrangement has the advantage that upon the opening of the main contacts 25, 84 (lifting the contact lever 41 off the stationary contacts 24), the spring force counteracting this motion does not increase substantially but remains approximately constant. This ensures a clean contact opening by the armature system 13 directly at the response value, which will be described later on.

Due to the hereinafore-described construction and suspension of the contact lever 41, it can execute a penedulum motion. The pendulum motion is promoted by the shape of the narrow support point 69, the width of which may be less than 2 mm. This ensures constant contact pressure on both main contacts 25, 84. The pendulum support also allows equilization in the event of different contact burn-off.

FIGS. 6, 7 and 8 represent the switch latch 49 in different switching states. FIG. 6 shows the switch latch 49 in the cocked condition, FIG. 7 shows it in the released condition and FIG. 8 shows it in cocked condition but with the main contacts 25, 84 open, which is due to the action of the striker pin 16 of the armature system 13.

The operation of the switching mechanism is as follows. The tripping is always accomplished by the release lever 37 or the manual actuating member 60. By rotating the tripping lever 37 in the direction of the arrow A, the pawl lever 89 is released and rotates in the direction of the arrow B. This releases the shaft 76 of the first toggle joint including two straps 77, 78 and slides upward in the elongated hole 79 in the pawl lever 89. The manual actuating member 60 turns under the action of a non-illustrated spring, in the direction of the arrow C into its off-position as shown in FIG. 7. The second toggle joint including the contact opening lever 57 and a strap 80 buckles under the action of the switching tension spring 81, the shaft 82 moving-off upward. The double-armed contact opening lever 57 has a projection 58 at each of its free leg ends which engage respectively behind a leg 59 of the contact lever 41. Because of the release of the switch latch 49, the contact opening lever 57 is guided in the elongated hole 83 and pulls the forked contact lever 41 with the movable contacts 42 away from the stationary contacts 24 by means of its projections 58, whereby the main contacts 25, 84 are opened.

In FIG. 7, the off-position of the switch latch 49 is shown, wherein the pawl lever 89 is again in its ready to be latched position.

As explained above, the tripping of the switch latch 49 is caused only by the thermo-bimetal strip 35 or the striker pin 56 of the magnetic end tripping device 47, i.e. if an overcurrent or a short-circuit current occurs, the pass value of which is larger than $D_K$ (see FIG. 3). In the event of short-circuit currents with smaller pass values, only main contacts 25, 84 are opened. As FIG. 8 shows, this occurs because the striker pin 16 of the armature system 13 directly strikes the connecting leg 62 of the U-shaped contact part 61 (more fully seen in FIG. 5), and thereby lifts the contact lever 41 with the movable contacts 42 off the stationary contacts 24. Tripping of the switch latch 49 does not occur at this point.

The suspension of the contact lever 41 in the plate 71 of the switch latch 49 is constructed in such a way that the contact lever 41 can be deflected further by the striker pin 16 than is possible if the contacts are opened by the contact opening lever 57 by means of its projections 58. By exceeding the amount of contact opening, the instantaneous arc path is increased if short-circuit currents occur. This leads to improved current limiting.

A coupling shaft 95 is supported in the two plates 71 covering up the switch latch 49. A lever 96 which is formed on the coupling shaft 95 engages behind one end 97 of the tripping lever 37. After breaking out suitable premarked places in the automatic switch housing, the coupling shaft 95 can serve as a connecting member to adjacent protective circuit breakers. If an adjacent protective circuit breaker is tripped, the tripping lever 37 of the automatic switch according to the invention can be actuated by the coupling shaft 95 and the switch latch 49 released.

FIG. 9 shows an enlarged insulating plate 28 which is attached to the ends 30 of the deion laminations to prevent egress of the arc. The insulating material plate 28 has break-throughs 29 on all sides which serve for venting the arcing chamber. The insulating plate 28 is formed of Plexiglass. When heated, this material gives off gases heavily, and thereby causes a pressure build-up in the arcing chamber if an arc occurs there and intensive cooling of the arc so that the quenching action is aided.

FIG. 10 shows a circuit diagram of an automatic switch according to the invention. The current enters the breaker circuit through a first terminal 11. It flows through the armature system 13 to the first main contact 25 which is shown in open condition and is shunted by an arc quenching device with arc guide bars 23, 26 and stacks 27 of quenching laminations. Connected in series with this first main contact 25 is a second main contact 84, which is of identical construction to the first main contact 25. Both main contacts 25, 84 are connected to each other by means of a rigid contact lever 41. From the stationary contact 24 of the second main contact 84, the current path leads through a connecting line 34 to a thermo-bimetal strip 35, from there through a flexible connecting lead 38 to a rigid connecting conductor section 39 and to the second terminal 40. Between the two main contacts 25, 84 there is a soldering tie point constructed as a lug 48, at which a part of the current is branched off. The partial current flows through a resistor 43 with a positive temperature coefficient, a thermo-bimetal element 44, and a flexible connecting lead 51 to the second terminal 40. An end 54 of the coil wire of a magnetic end tripping device 47 is furthermore fastened to the lug 48. The other end 55 of the coil wire leads to a fixed contact 52, opposite which a contact 50 is arranged. The contact 50 is attached to the free end of the thermo-bimetal element 44. The two contact pieces 50, 52 form an auxiliary contact 46 shown in the open state.

The arrangement including the resistor 43, the thermo-bimetal element 44, the magnetic end tripping device 47 and auxiliary contacts 46 is referred to herein as the selective protection tripping device.

The operation of the arrangement given by the circuit diagram is as follows. If an overload current flows through the arrangement by way of the armature system 13, the two main contacts 25, 84 and the thermo-bimetal strip 35, then the thermo-bimetal strip 35 is deflected and causes the switch latch 49 to be tripped as indicated by the functional line 85, which leads to a permanent opening of the main contacts 25, 84. In the case of a short-circuit current, the armature system 13 causes the immediate and direct opening of the main contacts 25, 84, as indicated by the functional line 86. The selective protection tripping device becomes effective only if in the case of a short-circuit current, the main contacts 25, 84 are open and an arc burns in each of them, and if the pass value of the short-circuit current exceeds a predetermined value (pass value $D_K$ in FIG. 3). This can either be the case if the short-circuit current is very large or if the short-circuit current occurs for an extended period of time without interruption of rapidly succeeding intervals. The thermo-bimetal element 44 is then deflected so far that the auxiliary contact 46 is closed. In this case, the magnetic end tripping device 47 is inserted into the auxiliary circuit. The device responds and trips the switch latch 49, as indicated by the functional line 87. As in the case of an overcurrent, this also leads to a permanent opening of the main contacts 25, 84 (functional line 88). The main contacts 25, 84 can then be closed only by the manual actuating member 60 through the switch latch 49.

As can already be seen from the tripping characteristics $A_{HS1}$ and $A_{HS2}$ of the thermo-bimetal elements 35, 44, the thermo-bimetal element 44 of the selective protection tripping device is more sensitive than the thermo-bimetal strip 35 which is included in the main circuit.

The positive temperature coefficient of the resistor 43 protects the thermo-bimetal element 44 against large overcurrents.

We claim:

1. Automatic switch comprising at least one main contact device having at least one stationary contact and at least one movable contact, a movably supported contact lever attached to said at least one movable contact, a switch latch connected to said main contact for opening said main contact, an overload current tripping device formed of a thermo-bimetal connected to said switch latch for causing said switch latch to open said main contact upon the occurrence of an overload current, a short-circuit current tripping device connected to said switch latch for causing said switch latch to open said main contact upon the occurrence of a short-circuit current, and an additional armature system having a magnet coil, a magnet core, a magnet armature and a striker pin, said striker pin being operable for directly striking said at least one movable contact lever and for lifting said at least one movable contact from said at least one stationary contact for a given limited time in the event of short-circuit currents.

2. Automatic switch according to claim 1, including a narrow dish-shaped two-part housing for the automatic switch.

3. Automatic switch according to claim 1, including at least one arc quenching device associated with each main contact device, and a first terminal, said additional armature system being disposed in the immediate vicinity of said at least one arc quenching device and in the vicinity of said first terminal.

4. Automatic switch according to claim 1, including plates covering said switch latch, said movable contact lever being rotatably supported by said plates.

5. Automatic switch according to claim 2, wherein said switch latch includes a member protruding from substantially the middle of the front of said housing for manually actuating said switch latch, a lever for tripping said switch latch, and a lever for opening said contacts, said additional armature system having an exit opening for said striker pin formed therein, and said movable contact lever being disposed in front of said exit opening.

6. Automatic switch according to claim 5, wherein said tripping lever of said switch latch and said movable contact lever are disposed on two diametrically opposite sides of said switch latch, and said overload tripping device and said short-circuit tripping device are disposed in the immediate vicinity of said tripping lever for directly acting thereon.

7. Automatic switch according to claim 3, including a second terminal, said overload and short-circuit current tripping devices being disposed in the vicinity of said second terminal.

8. Automatic switch according to claim 1, including a permanent magnet holding said magnet armature of said additional armature system in a starting position, said permanent magnet being torn away from said magnet armature for driving said striker pin after a predetermined short-circuit current value is exceeded.

9. Automatic switch according to claim 5, wherein said contact opening lever of said switch latch acts on said movable contact lever exclusively when said switch is tripped and lifts said at least one movable contact from said at least one stationary contact.

10. Automatic switch according to claim 1, wherein said at least one main contact device is in the form of two electrically series-connected main contacts each having an associated arc quenching device.

11. Automatic switch according to claim 10, wherein said movable contact lever is in the shape of a fork having fork ends, and one of two movable contacts of said two main contacts is disposed on each fork end.

12. Automatic switch according to claim 11, wherein said movable contact lever is of symmetrical construction, having a plane of symmetry disposed between said two movable contacts.

13. Automatic switch according to claim 12, wherein said switch latch includes side plates, and said movable contact has first and second opposite sides and includes a stationary shaft fastened to said side plates on which said movable contact lever is rotatably supported at a support point in said plane of symmetry at said first opposite side, and said movable contacts are disposed at said second opposite side and are swingable in a pendulum motion.

14. Automatic switch according to claim 13, including a pendulum shaft having ends and being centrally engaged in said movable contact lever between said movable contacts and said support point, and two contact pressure tension springs each having two opposite ends, one of said springs being hung at one end thereof from each end of said pendulum shaft.

15. Automatic switch according to claim 14, wherein said side plates have stationary abutments formed thereon, and the other end of each of said springs opposite the one end hung on said pendulum shaft, being hung on one of said abutments.

16. Automatic switch according to claim 15, wherein said pendulum shaft engages said movable contact lever at a given engagement point, and an imaginary line drawn between said engagement point and said support point forms an acute angle with an imaginary line drawn between said engagement point and one of said stationary abutments.

17. Automatic switch according to claim 14, wherein said fork shaped movable contact lever includes a U-shaped contact part having two legs carrying said movable contacts, a first angle piece and two second angle pieces fastened to said legs, said first angle piece being disposed flat on said U-shaped contact part and said second angle pieces being disposed perpendicularly to said first piece in said plane of symmetry, said second angle pieces being connected to each other and having holes formed therein for receiving said pendulum shaft and for forming said support point.

18. Automatic switch according to claim 1, wherein said movable contact lever has at least one leg, and said switch latch includes a double-armed contact opening lever having two free ends, and projections disposed on said free ends engaging behind said at least one leg of said movable contact lever for deflecting said movable contact lever from a closed position and opening said at least one main contact device when said switch latch is tripped.

19. Automatic switch according to claim 1, wherein said switch latch opens said contact a given distance when it is tripped, and said movable contact lever is movable through a distance between said movable and stationary contacts which is greater than said given distance.

20. Automatic switch according to claim 1, wherein said at least one main contact device is in the form of two main contacts each having an arc quenching device, and said arc quenching devices include a partition of insulating material having two sides and quenching chambers on both sides of said partition.

21. Automatic switch according to claim 1, including at least one arc quenching device associated with each main contact device, said arc quenching device including two arc guiding bars having ends, and a stack of deion laminations being disposed between said bars and having ends protruding beyond said bar ends.

22. Automatic switch according to claim 21, including at least one arc quenching device associated with each main contact device, said arc quenching device having an entrance side for an arc and an opposite side, and an insulating plate covering said opposite side.

23. Automatic switch according to claim 22, wherein said insulating plate is formed of a material which gives off gases upon being heated.

24. Automatic switch according to claim 22, wherein said insulating plate is formed of Plexiglass.

25. Automatic switch according to claim 22, 23 or 24, wherein said insulating plate has break-throughs formed therein.

26. Automatic switch according to claim 1, including at least one arc quenching device associated with each main contact device, and a switch housing having a side adjacent said at least one arc quenching device and having venting openings formed in said side in labyrinth fashion by offset webs.

27. Automatic switch according to claim 1, wherein said at least one main contact device is in the form of a first series-connected main contact and a second series-connected main contact being connected in series with said overload tripping device and including first and second terminals, and an arc guiding bar associated with said movable contact of said first main contact, said short-circuit current tripping device being electrically conductingly connected between said arc guiding bar and said second terminal and being shunted across said second main contact and said overload tripping device.

28. Automatic switch according to claim 27, wherein said switch latch includes a tripping lever and said short-circuit current tripping device includes a temperature-sensitive tripping device having a free end and a clamped end, an electric resistor having a free lead connected to said arc guiding bar and another lead connected in series with said clamped end of said temperature-sensitive tripping device, said free end of said temperature-sensitive tripping device being connected to said second terminal and including a first contact of an auxiliary contact being open in a no-current condition of the switch, a second contact of said auxiliary contact being disposed opposite to said first contact thereof and a magnetic tripping device being connected parallel to said resistor and temperature-sensitive tripping device between said arc guiding bar and said second contact of said auxiliary contact, said magnetic end tripping device having a coil and a striker pin for acting on said tripping lever of said switch latch.

29. Automatic switch according to claim 28, wherein said temperature-sensitive tripping device of said short-circuit current tripping device is more sensitive than said overload tripping device.

30. Automatic switch according to claim 28, wherein said resistor is formed of a chromium-aluminum alloy.

31. Automatic switch according to claim 28, wherein said temperature-sensitive tripping device is deflectable in a given direction, and including a connecting line section electrically inserted between said free end of said temperature-sensitive tripping device and said second terminal, said connecting line section being disposed parallel to and at a distance from said temperature-sensitive tripping device toward said given direction.

32. Automatic switch according to claim 31, wherein said temperature-sensitive tripping device is formed at least in part of ferro-magnetic material.

33. Automatic switch, comprising a dish-shaped two-part narrow housing for holding the switch having a rectangular profile, a front and walls, first and second terminals, a partition formed of insulating material, two arcing chambers in the vicinity of said first terminal being disposed one behind the other widthwise in said housing on either side of said partition, an additional armature system being disposed in the vicinity of said first terminal and in the immediate vicinity of said arcing chambers, a bridge of insulating material separating said additional armature system from said arcing chambers, said additional armature system having an exit opening formed therein and having a striker pin movable through said exit opening, a switch latch being disposed in front of said exit opening and having a manual actuating member protruding substantially centrally from the front of said housing, a forked movable contact lever disposed directly adjacent to said additional armature system, said movable contact lever being rotatably supported at a support point by said switch latch, being directly actuatable by said striker pin, and having two movable contacts disposed thereon being openable by said switch latch, a tripping lever being attached to and extended beyond said switch latch diametrically opposite to said support point, an overload tripping device being disposed in the vicinity of said second terminal and in the vicinity of and parallel to one of said housing walls, said overload tripping device having a free end for acting on said tripping lever and a clamped end, said overload tripping device being formed on a thermo-bimetal causing said switch latch to open said movable contacts upon the occurrence of an overload current, and a short-circuit current tripping device having a magnetic end tripping device also acting directly on said tripping lever for causing said switch latch to open said movable contacts upon the occurrence of a short-circuit current.

* * * * *